US005577447A

United States Patent [19]

Weber et al.

[11] Patent Number: 5,577,447

[45] Date of Patent: Nov. 26, 1996

[54] AUTOMATIAC RAILWAY FASTENER REMOVER

[75] Inventors: Robert M. Weber, Ingleside, Ill.; William D. Straub, Milwaukee, Wis.

[73] Assignee: Oak Industries, Inc., Waltham, Mass.

[21] Appl. No.: 489,651

[22] Filed: Jun. 12, 1995

[51] Int. Cl.[6] ..... E01B 29/28

[52] U.S. Cl. ..... 104/2; 104/17.1

[58] Field of Search ..... 104/2, 17.1, 17.2, 104/307; 81/13, 44, 55, 57.14

[56] References Cited

U.S. PATENT DOCUMENTS

| | | | |
|---|---|---|---|
| 891,700 | 6/1908 | Jacobs | 81/57.13 |
| 910,201 | 1/1909 | Jenkins | 81/57.13 |
| 953,668 | 3/1910 | Kendrick | 81/57.22 |
| 956,856 | 5/1910 | Jacobs | 104/17.1 |
| 975,042 | 11/1910 | Jacobs | 144/35 |
| 1,060,173 | 4/1913 | Edwards | 29/26 A |
| 1,072,618 | 9/1913 | Kendrick | 144/35 |
| 1,670,007 | 5/1928 | Rasmussen et al. | 105/27 |
| 1,995,168 | 3/1935 | Bronander | 408/77 |
| 2,021,170 | 11/1935 | Bronander | 81/57.25 |
| 2,266,302 | 12/1941 | Blair | 81/57.37 |
| 2,591,005 | 4/1952 | Piper | 144/35 |
| 2,973,021 | 2/1961 | Crossen | 81/430 |
| 2,993,394 | 7/1961 | Scott | 81/55 |
| 3,064,428 | 11/1962 | Plasser et al. | 60/468 |
| 3,294,130 | 12/1966 | Dorrer | 81/430 |
| 3,759,334 | 9/1973 | Theurer | 173/185 |
| 3,762,333 | 10/1973 | Theurer et al. | 104/12 |
| 4,062,388 | 12/1977 | DeCaro | 81/57.37 |
| 4,256,040 | 3/1981 | Dieringer | 104/17.1 |
| 4,319,392 | 3/1982 | Cutts | 104/17.2 |
| 4,416,172 | 11/1983 | Medinger | 81/57.37 |
| 4,442,738 | 4/1984 | Spencer | 81/470 |
| 4,580,501 | 4/1986 | Collins et al. | 104/307 |
| 4,674,367 | 6/1987 | Aab et al. | 81/57.37 |
| 4,762,030 | 8/1988 | Nguyen | 81/13 |
| 4,777,885 | 10/1988 | Dieringer | 104/17.1 |
| 5,088,359 | 2/1992 | Hockman | 81/57.37 |
| 5,191,840 | 3/1993 | Cotic et al. | 104/17.1 |
| 5,398,616 | 3/1995 | Eidemanis et al. | 104/17.2 |
| 5,465,667 | 11/1995 | Hosking et al. | 104/17.1 |

FOREIGN PATENT DOCUMENTS

| | | | |
|---|---|---|---|
| 0153772 | 9/1985 | European Pat. Off. . | |
| 2406029 | 5/1979 | France . | |
| 957487 | 2/1957 | Germany | 104/2 |
| 37093390 | 11/1988 | Germany | 104/17.2 |
| 0619967 | 5/1961 | Italy . | |
| 0241489 | 4/1969 | U.S.S.R. . | |
| 831891 | 5/1981 | U.S.S.R. | 104/2 |
| 1268653 | 11/1986 | U.S.S.R. | 104/17.2 |
| 1289945 | 2/1987 | U.S.S.R. | 104/17.2 |
| 1472550 | 4/1989 | U.S.S.R. . | |
| 1687697 | 10/1991 | U.S.S.R. . | |
| 1735475 | 5/1992 | U.S.S.R. | 104/17.2 |

*Primary Examiner*—S. Joseph Morano
*Attorney, Agent, or Firm*—Greer, Burns & Crain, Ltd.

[57] ABSTRACT

An automatic rail fastener remover for use on threaded fasteners being used for securing railroad rails to rail ties, the fastener remover constructed and arranged to be mounted on a railway maintenance vehicle having a frame, and including a fastener removal tool configured to releasably engage one of the fasteners for removing the fastener from the tie, a drive assembly connected to the tool for rotating the tool, at least one latch hook selectively biased against the fastener head for assisting the tool in the removal of the fastener from the tie.

20 Claims, 5 Drawing Sheets

AUTOMATIAC RAILWAY FASTENER REMOVER

BACKGROUND OF THE INVENTION

The present invention is related to machines used in performing railway right-of-way maintenance, and specifically to an automatic apparatus for removing threaded rail fasteners such as lag screws from wooden rail ties.

Conventional railroad rails are secured to the ties by so-called cut spikes which are driven by vertically directed forces through tie plate apertures into the wooden railroad ties. However, it has been found that certain portions of track, such as those bearing high tonnage traffic, as well as curved track sections, wear out faster than others, and require more frequent replacement. A side effect of frequent rail replacement is that the spikes have a tendency to loosen in the ties, especially in high tonnage sections of track.

As a result of these conditions, maintenance directors of railroads have determined that alternate fastening technologies to cut spikes should be explored. One alternative is to use so-called hairpin spikes, which have depending prongs designed to spread apart within the tie. Although hairpin spikes are used in some high traffic portions of track, they are somewhat limited in their application, in that such spikes are more difficult to drive into and pull from the ties using automatic equipment.

Another type of fastener which is being considered is the rail lag screw, which is similar in dimension to a cut spike, with the major difference being that the lag screw is designed to be used with a rail clip, and is axially rotated into predrilled holes in the tie. As such the lag screw has a threaded shank and a polygonal, multi-faceted or TORX head for engagement by suitable driving tools.

Yet another type of alternate rail fastening system employs relatively permanent concrete ties having threaded studs embedded therein for securing the rails with clips. Upon placement of a rail on the concrete ties, nuts are threaded onto the studs to secure the rail and the tie plate. Designers of conventional automatic railway maintenance equipment have not provided an automatic rail fastener remover which may remove threaded lag screws as well as such nuts.

A conventional technique for working with rail lag screws employs a hand-held rotary impact wrench which engages the head of the spike and can either drive or remove the lag screw at the direction of the operator. However, a major drawback of this technique is that during placement, either two operators are required, e.g. one to place the screws and one to operate the impact wrench, or a single operator must perform both tasks at an appreciably slower pace. Either way, this technique is inefficient and labor intensive.

Designers of conventional automatic spike driving machines have traditionally focused on the problems of rapidly, accurately and quietly driving cut spikes into the ties with vertically directed pushing and/or percussive forces without bending individual spikes. One example of a cut spike driving machine employing such vertical forces is commonly-assigned U.S. Pat. No. 5,191,840.

An automatic fastener applicator for threaded rail fasteners is disclosed in commonly-assigned U.S. patent application No. 08/103,056, filed Aug. 6, 1993 now U.S. Pat. No. 5,398,616 which is incorporated by reference herein. Although the U.S. Pat. No. 5,398,616 discloses a device for accurately installing threaded rail fasteners into the ties, there is no disclosure for addressing the unique considerations involved in removing such fasteners.

Among the design considerations encountered in removing threaded rail fasteners of this type are that the fastener must be grasped or supported in some way to withdraw or pull it from the tie as it is being unscrewed. In addition, consideration must be paid to maintain the engagement between the rotating socket which engages the head or faceted portion of the fastener, and the head of the fastener itself. Another design consideration is that lag screws or other threaded fasteners have been known to become stripped in their holes in the tie. In such cases, merely counter-rotating the fastener head will not accomplish its removal. Similarly, lag screws may become misaligned or driven off center in the insertion process, which causes additional difficulties in their removal.

Thus, there is a need for a machine which can automatically and reliably remove threaded rail fasteners such as lag screws, and which permits an operator to remove stripped or misaligned screws or other fasteners, such as nuts threaded on fixed studs.

Consequently, a first object of the present invention is to provide an improved device which can automatically remove threaded rail fasteners, such as lag screws and/or nuts without manual handling.

Another object of the present invention is to provide an improved rail fastener removing device which can remove lag screws and/or nuts by supporting or pulling the fastener as it is being unscrewed.

Still another object of the present invention is to provide an improved rail fastener removing device which features the capability of removing stripped or misaligned fasteners.

A still further object of the present invention is to provide an improved rail fastener removing device which automatically unscrews and fully removes the fastener from the corresponding hole in the tie.

SUMMARY OF THE INVENTION

Accordingly, the above-identified objects are met or exceeded by the present automatic rail fastener remover. The present remover is preferably mounted on a self-propelled, operator directed frame, and includes an automatic drive portion which rotates a socket or tool for engaging the fastener, a locating assembly which positions the socket relative to the fastener for removal purposes, and a latch hook which is provided with its own guide assembly. A major advantage of the present fastener remover is that the hook selectively exerts a lateral biasing force on the fastener to support the engagement of the socket only after the socket has engaged the fastener. In addition, the hook may be vertically retracted to pull the fastener from the tie as it is unscrewed by the socket.

More specifically, the present invention provides an automatic rail fastener remover for use on threaded fasteners used to secure railroad rails to rail ties, the fastener remover being constructed and arranged to be mounted on a railway maintenance vehicle having a frame. The remover includes a fastener removal tool configured to releasably engage one of the fasteners for removing the fastener from the tie, and a drive assembly connected to the tool for rotating the tool. At least one holding device is provided on the fastener remover for maintaining engagement of the tool with the fastener in the removal of the fastener from the tie. In the preferred embodiment, the tool is a socket, and the holding device is a latch hook.

In another embodiment, the present invention provides a railway maintenance machine having an automatic rail fastener remover for use on threaded fasteners used to secure rails to rail ties of a railroad track. The machine includes a frame which is movable along the track. Being mounted to the frame, the fastener remover includes a fastener removal tool configured to releasably engage one of the fasteners for removing the fastener from the tie. A drive assembly is connected to the tool for rotating the tool, and a locating assembly is connected to the tool and to the frame for reciprocating the tool relative to the fastener between a ready position and an engagement position. Also included with the fastener remover is at least one holding device mounted on the fastener remover for assisting the tool in the removal of the fastener from the tie.

In yet another embodiment, a latch hook is provided for use with an automatic rail fastener remover for use on threaded fasteners used to secure railroad rails to rail ties, the fastener remover constructed and arranged to be mounted on a railway maintenance vehicle having a frame. The fastener remover also includes a fastener removal tool configured to releasably engage one of the fasteners for removing the fastener from the tie, a drive assembly connected to the tool for rotating the tool, a locating assembly connected to the tool and to the frame for reciprocating the tool to the fastener between a ready position and an engagement position, and a hook guide assembly associated with the locating assembly for manipulating the hook relative to the tie so that the hook engages the tie plate independent of the engagement of the tool upon the fastener.

The hook includes a generally vertically projecting, elongate body having an upper end and a lower end, a front face and a rear face. A transverse pivot bore is located at the upper end. The lower end has a foot projecting from the front face, and having a tip with a beveled edge. An arcuate recess is defined on the tip between two outer tip ends, and at least one rearwardly projecting ear is located at the upper end. The ear has a transverse throughbore.

DESCRIPTION OF THE PREFERRED EMBODIMENT

Figure 1:
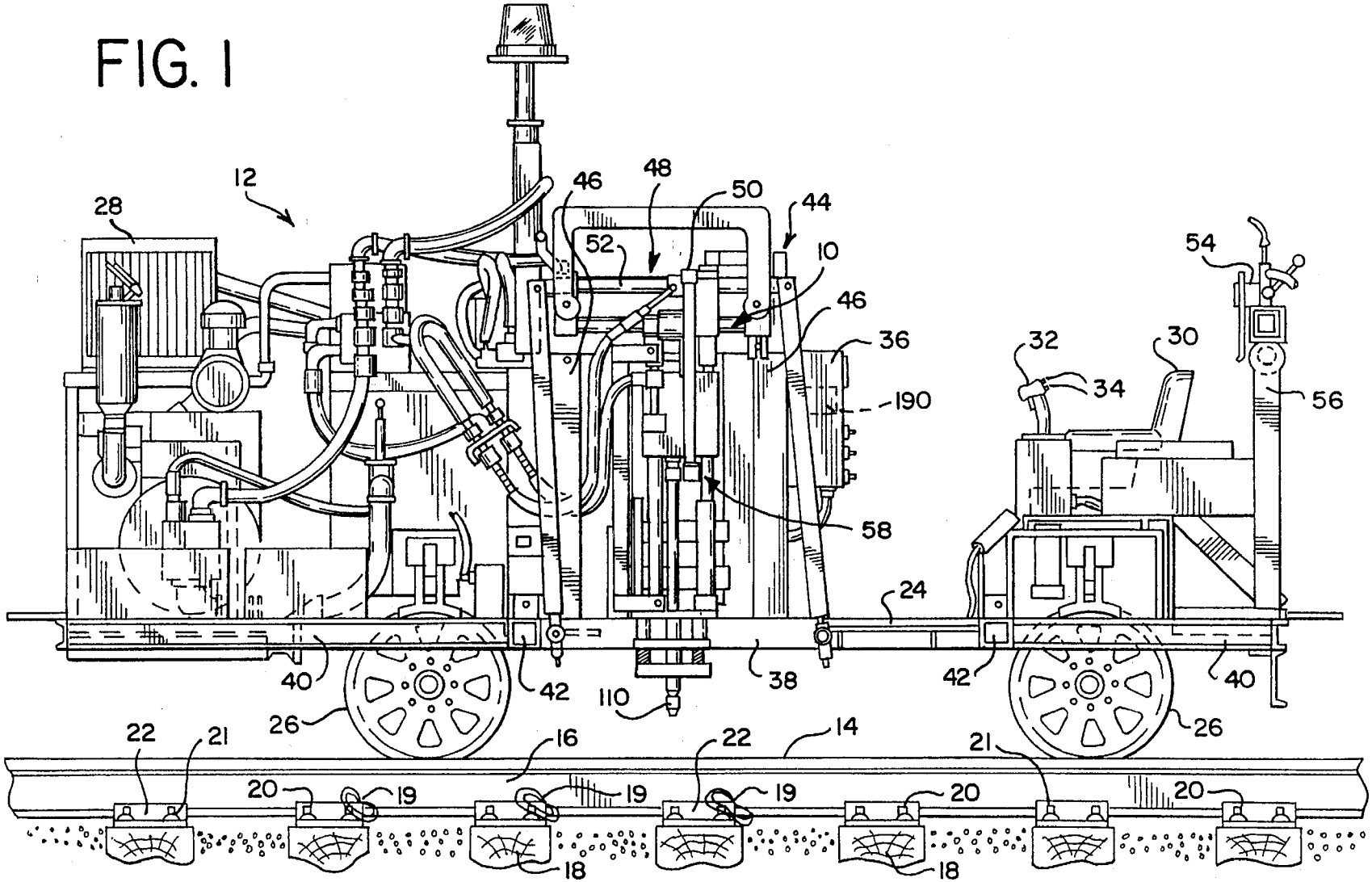
FIG. 1 is a side elevational view of a railway maintenance vehicle of the type suitable for use with the present rail fastener remover.

Referring now to FIG. 1, the present fastener remover device, also referred to as a lag screw or fastener remover module, is generally designated 10 and is designed for mounting upon a railway maintenance machine or base unit, generally designated 12. The machine 12 is preferably designed to be selfpropelled on a railroad track 14, however remote propulsion sources are contemplated. The track 14 includes a pair of rails 16 (only one pictured), and a plurality of rail support members commonly referred to as ties 18, to which the rails are connected by clips 19 held by fasteners 20 which pass through tie plates 2. In the preferred embodiment, the fasteners 20 are lag screws having faceted or polygonal or hex heads 21. However, it is also contemplated that the fasteners may have TORX heads, or that the present device 10 may be used with nuts, such as hex type nuts, to be threaded upon vertically projecting studs (not shown) as are known in the art for securing clips to tie plates and ultimately, to the tie.

The base unit 12 includes a frame 24 supported on a plurality of wheels 26 such that the frame can be moved thereon along the rails 16. The frame 24 preferably supports a source of motive power 28 such as an internal combustion engine, which propels the unit 12 and also powers the fluid power system, which in the preferred embodiment is hydraulic. However, it is also contemplated that the present fastener removing device 10 and the frame 24 may be pulled or towed along the track. Also supported on the frame 24 is at least one operator's seat 30. At least one of the operator's seats 30 is provided with at least one control joystick 32 having at least one trigger or other functional controls such as actuator buttons 34. The operator's seat and the joystick 32 are located in operational proximity to a central control panel 36.

Included on the frame 24 are a pair of generally parallel main tubes 38. The main tubes 38 are positioned to be approximately parallel to the rails 16 and are fixed at each end to generally rectangular portions 40, each of the latter including a transversely positioned cross tube 42.

A centrally located, elevated portion 44 of the frame 24 is supported by generally vertical columns 46 which are joined at their respective upper ends by horizontal beams (not shown) to define a generally box-shaped operational zone 48. The operational zone 48 is the area within which the present fastener remover module 10 is connected.

At the top of the elevated portion 44 is located a spotting carriage 50 for manipulating the module 10 in the directions both parallel and transverse to the rails 16. The carriage includes at least one fluid power cylinder 52 for controlling movement of the module 10 in each of the parallel and transverse directions. Greater details of the construction and operation of the spotting carriage 50 are disclosed in U.S. Pat. No. 5,398,616, which has been incorporated by reference. If desired, the frame 24 may also be provided with a winch 54, which, in the preferred embodiment is mounted on a rear frame guard member 56 located behind the operator's seat 30.

Referring now to FIGS. 1–3 and 5, the present automatic rail fastener remover module 10 is shown in greater detail. Basically the module 10 includes at least one, and preferably two fastener remover units 58 which are commonly referred to as fastener remover guns. One such gun 58 is provided for performing work on each side of the rail 16, however for purposes of clarity, only one such gun is depicted. Each gun 58 is suspended from the spotting carriage 50 of the frame 24 in a known manner by engagement in depending sockets 60 (shown fragmentarily in FIGS. 2 and 3) of the spotting carriage 50.

Engagement of the sockets 60 is accomplished by a pair of generally vertically oriented guide shafts 62 which have upper transverse throughbores 64 which correspond to similar bores in the sockets 60. Suitable threaded fastener assemblies 66 (best seen in FIG. 2) including bolts, lockwashers and nuts, are used to pin the shafts to the sockets 60. Lower ends of the shafts 62 are engaged in lower sockets 68. A mounting bracket 70 is secured between upper and lower ends of one of the shafts 62 (best seen in FIG. 3). If desired, brackets 72 may be used to prevent the lower ends of the shaft from flexing beyond a specified amount, and secure the lower ends of the shafts to the frame 24.

A drive mounting bracket 74 is basically rectangular or ladder-like in configuration, including a pair of elongate vertical side members 76, and upper, middle and lower horizontal members 78, 80 and 82, respectively. Upper and middle horizontal members 78 and 80 have coaxial holes through which a pair of guide shaft sleeves or bushings 84 are attached, as by welding. A mounting tab 86 is integrally mounted upon the middle horizontal member 80 of the bracket 74 to extend laterally from the bracket, and has an aperture 88 which serves as the attachment point of an end of a main drive cylinder 90.

Figure 2:
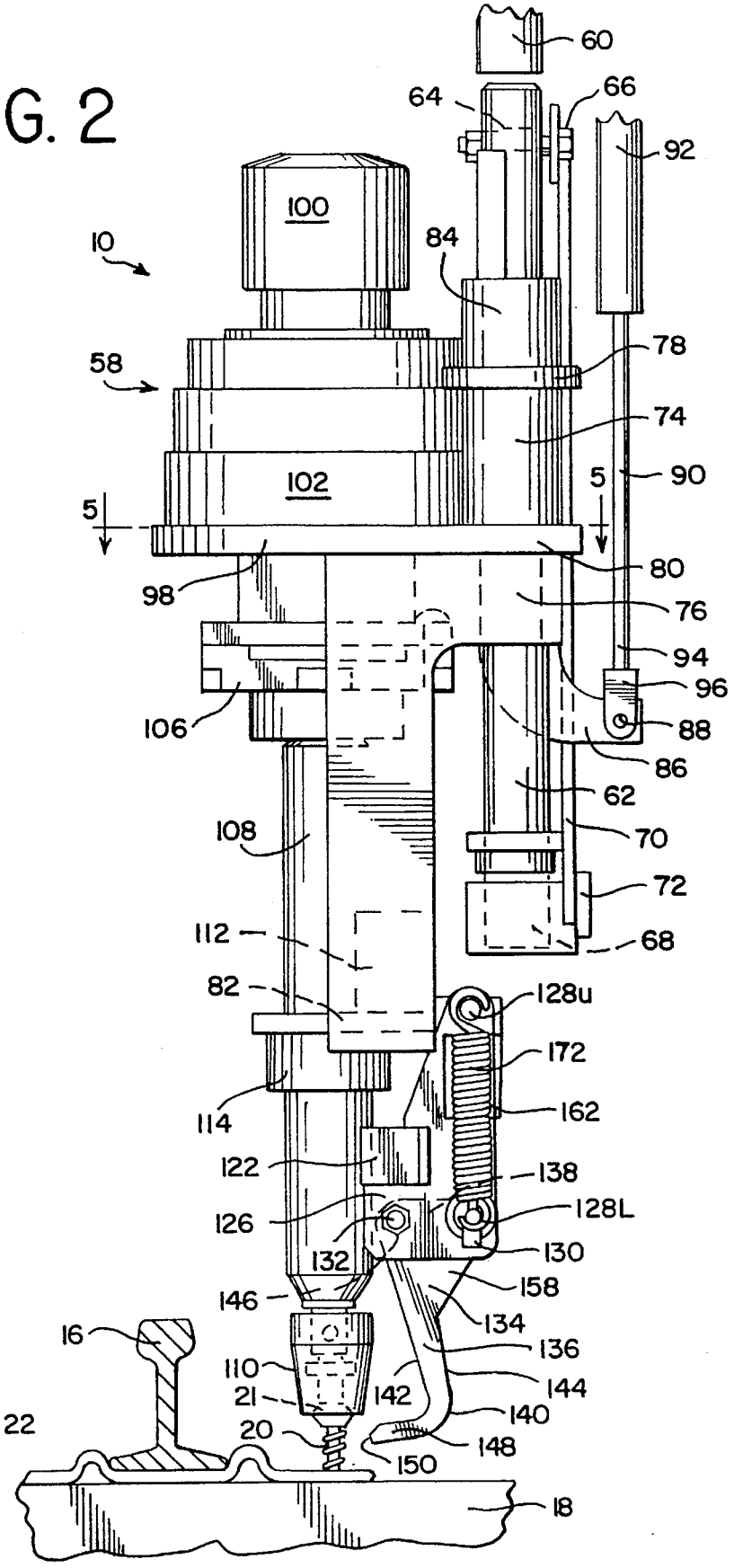
FIG. 2 is a front elevational view of the present automatic rail fastener remover.

Either the blind end 92 (shown fragmentarily) or the rod end 94 of the cylinder 90 may be attached to the tab 86 through a clevis mount 96 (best seen in FIG. 2). The opposite end of the cylinder 90 is secured to the spotting carriage 50. Extension and retraction of the cylinder 90, which is under the control of the operator via the hand controller buttons 34 on the joystick 32, serves to reciprocally move the drive mounting bracket 74 on the guide shafts 62. The shafts 62, the bracket 74 and the cylinder 90 may be collectively referred to as the locating assembly.

Extending in an opposite direction from the mounting tab 86 on the middle horizontal member 80 is found an annular gear box mount bracket 98. Located upon the bracket 98 is a planetary gear drive unit 102 upon which a drive motor 100 is mounted which provides the driving force for the removal of fasteners 20. In the preferred embodiment, the motor 100 is a reversible, hydraulically-powered unit, and the use of multiple speed motors is desirable for applications where high speed operation is feasible. However other suitably equivalent motors, or hydraulic impact wrenches or electric motors are contemplated.

Depending through an opening 104 in the motor mount bracket 98 is an extension adapter 106, which operatively connects the planetary gear drive unit 102 to an elongate extension 108. An upper end of the extension 108 is connected to the adapter 106, and an opposite and lower end is provided with a fastener removal tool 110, which in the preferred embodiment is a octagon-type drive socket. It is also contemplated that other types of fastener removal tools, such as, but not restricted to TORX bits, may also be employed here as are known in the art.

Returning now to the drive mounting bracket 74, the lower horizontal member 82 is provided with a pair of vertically oriented guide rod bushings and sleeves 112, as well as a drive extension bushing and sleeve 114 (best seen in FIG. 2). The drive extension bushing 114 provides lateral support to the extension 108.

Inserted into each of the guide rod bushings 112 is a corresponding guide rod 116, which is held in suspended, slidable orientation therein by a transverse retaining pin 118 which engages the top of the bushing to prevent the rod 116 from falling out the bottom. Directly below the lower horizontal member 82, the guide rods are each surrounded by a coil spring 120, the upper end of which impacts the underside of the lower horizontal member, the lower end of which is abutted against a hook cylinder mounting bracket or weldment 122. The guide rods 116, the pins 118 and the springs 120 may be collectively referred to as the hook guide assembly.

The hook cylinder mounting bracket or weldment 122 includes a pair of sockets 124 dimensioned to retain lower ends of the guide rods 116. Thus, the hook cylinder mounting bracket 122 is vertically movable relative to the drive mounting bracket 74. Also included on the hook cylinder mounting bracket are a pair of hook cylinder support plates 126 having upper and lower transversely projecting spring retaining pins respectively designated 128U and 128L, a lower elongate hook travel slot 130, and a hook pivot pin 132 generally horizontally aligned with the hook travel slot.

A latch hook 134 (best seen in FIG. 2*e*), is disposed at a lower end of the hook cylinder mounting bracket 122 to pivot in an arc relative to the lower end of the drive socket 110. The purpose of the latch hook is to support the lag screw or nut 20 as it is removed from the tie, and to assist in the lifting of such fasteners by providing them with support as they are withdrawn.

Figure 2A:
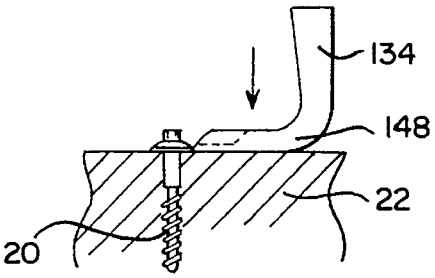
FIGS. 2*a*–2*d* are fragmentary schematic representations of the cycle of operation of the present automatic rail fastener remover as it removes a rail fastener.
Figure 2B:
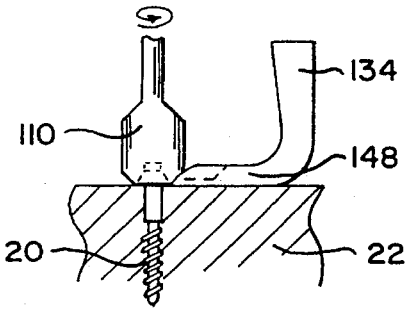
Figure 2E:
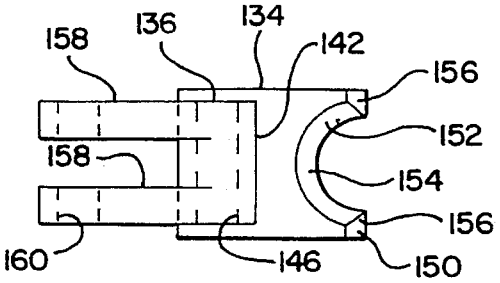
FIG. 2*e* is an overhead plan view of a latch hook of the type employed in the preferred embodiment of the present rail fastener remover.
Figure 3:
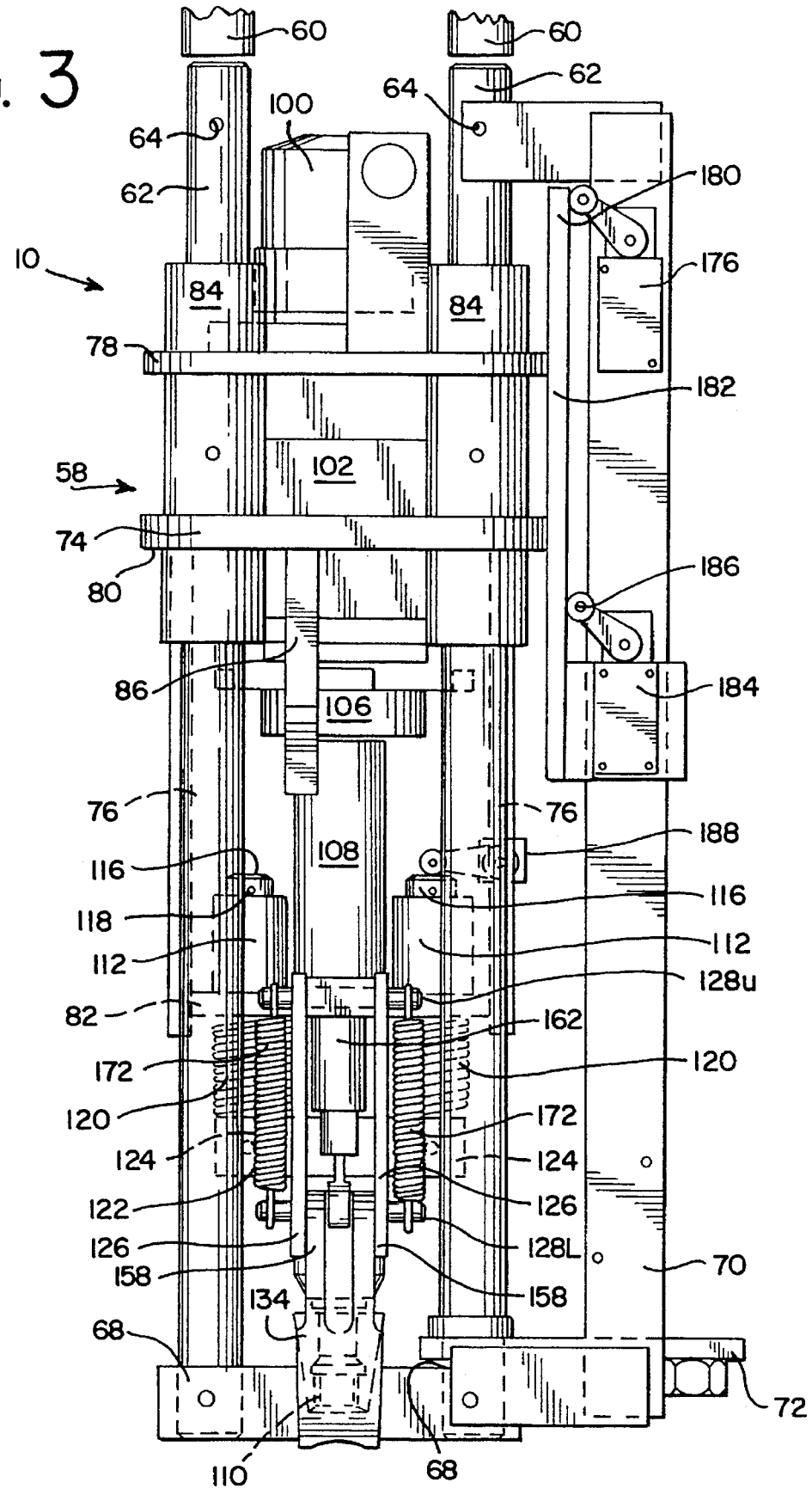
FIG. 3 is a side elevational view of the present automatic rail fastener remover as shown in FIG. 2.

More specifically, and referring to FIGS. 2, 2*e* and 3, the latch hook 134 includes a generally vertically projecting, elongate body 136 having an upper end 138 and a lower end 140, a front face 142 and a rear face 144. From the side, the hook 134 has a generally "L"-shaped configuration (best seen in FIG. 2). A transverse pivot bore 146 is disposed at the upper end 138 and is dimensioned to be coaxial with the hook pivot pin 132 to provide a pivot point for the hook 134. The lower end 140 has a foot 148 projecting from the front face 142. A tip 150 has a beveled edge 152 and defines an arcuate recess 154 between two outer tip ends 156. At least one and preferably two rearwardly projecting ears 158 are located at the upper end 138o Each ear 158 has a transverse throughbore 160.

The throughbore 160 is constructed and arranged to be coaxial with, and to be engaged upon, the hook travel slot 130 on each of the hook cylinder support plates 126. Upon assembly, the latch hook 134 is pivotable about the pins 132 in an arc between a retracted or ready position (best seen in FIG. 2), and an engagement position (best seen in FIG. 2*c*). In the engagement position, the hook engages and supports the faceted or head portion of the fastener 20.

An important feature of the present invention is that once initiated by the operator, this pivoting action is automatic. In the preferred embodiment, the hook automatically exerts a generally laterally-directed biasing force in the engagement position. This force is generated by the use of a fluid power cylinder 162 which is mounted at a first end to the upper spring retaining pin 128U, and at a lower, opposite end to the lower spring retaining pin 128L in a clevis arrangement. As will be described below, this biasing force is preferably applied with a delay feature which facilitates total fastener extraction.

Figure 2C:
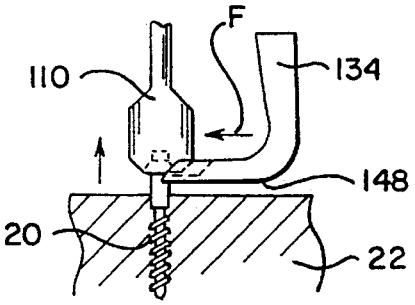

Retraction of the cylinder 162 places the hook in the ready position of FIG. 2, and extension of the cylinder causes the hook to exert the generally laterally directed biasing force in the engagement position of FIG. 2*c*. The pivotal travel of the hook 134 is limited by the vertical travel of the lower spring retaining pin 128L within the elongate hook travel slots 130. In the preferred embodiment, the hook cylinder 160 is a single acting hydraulic cylinder, and as such requires an outside force to retract it. Coiled retraction springs 172 are preferably associated with and are connected between the spring retaining pins 128U, 128L to perform this function.

Referring now to FIG. 3, the mounting bracket 70 serves as the mounting point for an UP position limit switch 176, which may be a mechanical type limit switch, a proximity switch, or other equivalent type of electronic position sensor and signalling device, is located near the upper end of the mounting bracket 70. The specific location of the switch 176 may be adjusted to suit the application, but is preferably placed at the desired upper position of the fastener remover guns 58 as determined by the travel of the driving cylinder 90.

In the preferred embodiment, the UP limit switch 176 is mounted to sense the position of an upper end 180 of a drive mount position bar 182, which is attached to one side of the drive mounting bracket 74. In the UP position, the drive socket 110 is in the uppermost or highest position, approximately 18 inches above the rails 16, and is the position used when the base unit 12 is moved long distances along the track between projects. In some cases, the drive socket 110 may be placed in a "WORK UP" position, in which the socket is retained at approximately 6–8 inches from the top of the embedded fastener. In this latter position, the base unit 12 may still be moved along the rail without fear of contacting the fasteners, and the socket 110 is more quickly brought into engagement with the next target fastener.

Located below the UP limit switch 176 is a READY position limit switch 184, which is preferably an identical unit to the switch 176, and as such may be any sort of position sensing and signalling device. The READY position switch 184 is preferably secured to the mounting bracket 70 at a location which will place the drive socket 110 in operational proximity to the rail fastener 20, which is approximately ½–1 inch above the fastener. The READY limit switch 184 is triggered by the upper end 180 of the drive mount position bar 182 passing within its sensing apparatus, which in the depicted embodiment is a follower wheel 186 (best seen in FIG. 3). The READY limit switch 184 is fully adjustable to within ½ to 1 inch of the fastener head at a particular site.

A third limit switch, designated the DOWN position limit switch 188, is preferably located below the READY position switch 184 on the vertical side members 76 of the drive mounting bracket 74. Also preferably constructed as an identical unit to the switches 176, 184, the DOWN position limit switch is positioned to engage one of the guide rods 116 as it moves downward relative to the guide rod 116. This movement is encountered as the downwardly moving drive mounting bracket 74, including the drive socket 110 and the latch hook 134, impacts the tie plate 22. The foot 148 of the latch hook 134 impacts the tie plate 22 first, causing the guide rods 116 to move upward relative to the bushings 112 and also compressing the springs 120. All three of the limit switches 176, 184 and 188 are electrically connected to a central control system, including a microprocessor 190 (shown hidden in FIG. 1).

Figure 4:
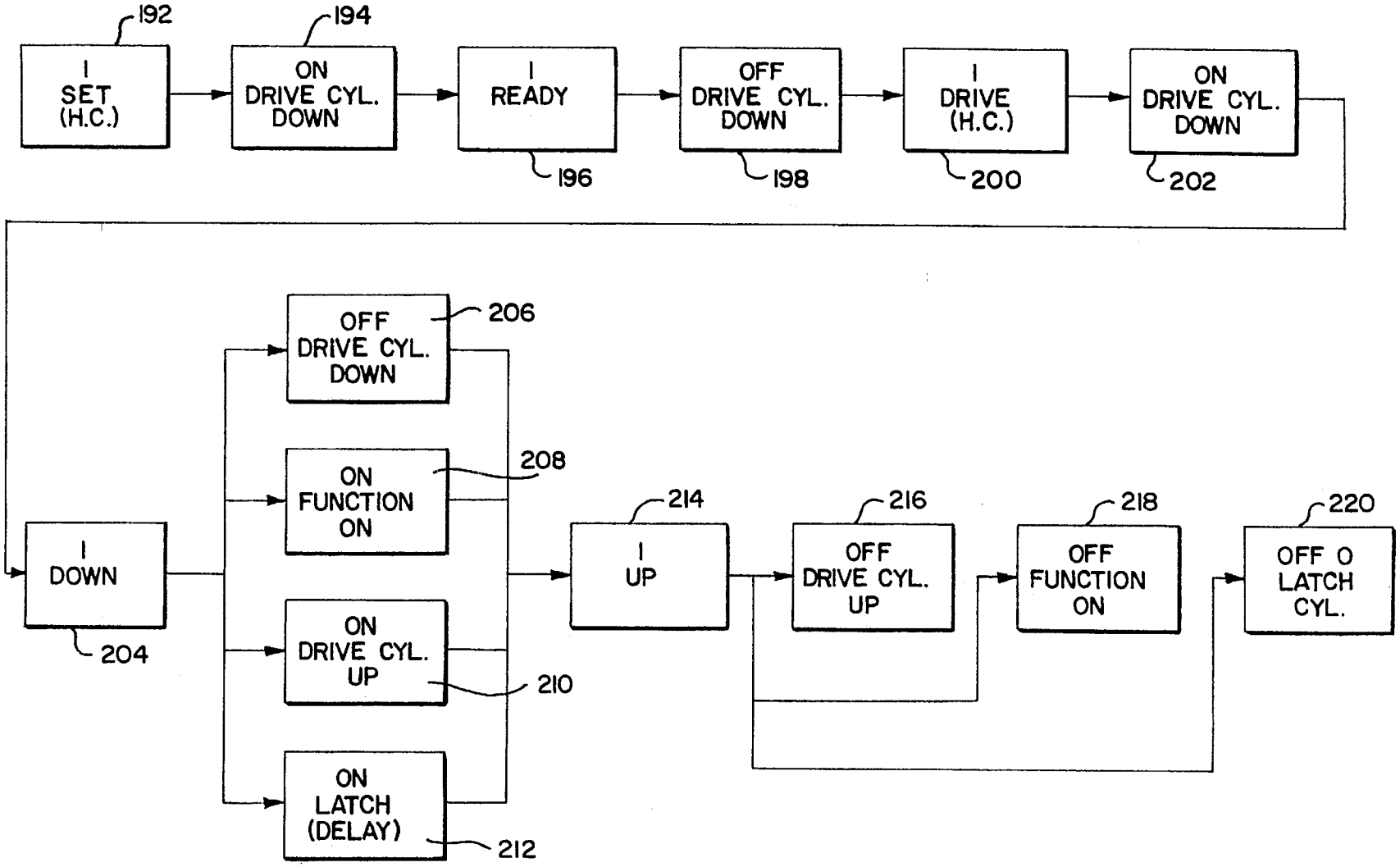
FIG. 4 is a schematic flow chart of the operational sequence of the present automatic rail fastener remover.

Referring now to FIG. 4, the control schematic for the present rail fastener remover 10 will be described in detail, and it will be understood that the control circuitry for carrying out these functions is primarily located behind the control panel 36. Basically, the operational goal of the device 10 is to have the latch hook 134 engage, or exert a lateral biasing force upon, the faceted head 21 of the fastener 20 only after the driving socket 110 has properly engaged the same faceted head and begun to counter-rotate the head to begin the fastener removal process.

Turning to the first function block or box 192, the joystick 32, designated as H.C. (hand control), places the fastener remover gun 58 in the READY position. In FIG. 4, "I" designates "input" The operation of block 192 is accomplished by the operator pressing one of the buttons 34 on the joystick. A signal generated by the button 34 causes the drive cylinder 90 to be turned on, as shown at block 194, to lower the drive mounting bracket 74 and attached components to the READY position, wherein the drive socket 110 is disposed approximately ½ to 1 inch above the fastener 20. In the READY position, indicated at box 196, the latch hook 134 has not yet engaged the tie plate 22. The drive cylinder 90 lowers the mounting bracket 74 until the READY limit switch 184 is triggered by the switch losing its signal from the position bar 182.

At this point, the drive cylinder 90 is turned off by the limit switch 184, as depicted in box 198. The operator then uses the joystick 32 to operate the spotting carriage 50 to properly and accurately position the drive socket 110 over the faceted head 21 of the fastener 20. Once the socket is properly positioned, to initiate the removal cycle, the operator then presses another button 34 on the joystick 32, as seen in box 200, which causes the drive cylinder 90 to be turned on again to lower the mounting bracket 74 still further, as seen in box 202.

This second downward movement of the drive socket 110 and its supporting assembly, including the mounting bracket 74, is terminated upon the DOWN position limit switch 188 being tripped by the upward movement of the guide rods 116 relative to the mounting bracket 74, represented by box 204. This tripping or actuation of the limit switch 188 turns off the drive cylinder 90, as shown in box 206.

The actuation of the DOWN position limit switch 188 is caused by the impact of the foot 148 of the latch hook 134 upon the tie plate 22 (best seen in FIG. 2*a*, with tie plate omitted for clarity). Thus, the latch hook 134 engages components of the track 14 prior to, or simultaneously with, and independently of, the drive socket 110. Associated with this engagement of the hook on the tie plate is the exertion by the hook of a generally vertical force on the tie plate, which is generated by the extending action of the drive cylinder 90.

An important second function of the DOWN limit switch 188 is the simultaneous energizing of four functions, the first of which being the turning off of the drive cylinder 90 and the lowering of, the socket 110, upon the faceted head 21 of the fastener, seen in box 206. Also, at the same time, the motor 100 is energized, which counter-rotates the extension 108 and the socket 110 to begin the removal of the fastener 20, seen in box 208 and also in FIG. 2*b*.

Another occurrence at this time is the raising of the drive cylinder 90, which retracts the socket 110 to allow the upward travel of the fastener from the tie 18, as seen in box 210. The last function performed at this time is the energization and extension of the latch hook cylinder 162 (best seen in box 212), which exerts a downward force on the ears 158 of the latch hook 134, and causes the hook to pivot about the pivot pin 132. In this manner, a generally laterally directed biasing force F is exerted against the fastener 20 (best seen in FIG. 2*c*).

In the preferred embodiment, a significant feature of the invention is that the timing of the exertion of the biasing force F is adjustable between an immediate exertion and a predetermined delay in the application of the force. The delay is employed to allow the fastener a chance to be at least partially withdrawn from its hole merely with counter-rotation. If so, excessive force need not be exerted by the hook 134, and unnecessary wear on the arcuate recess 154 of the latch hook 134 is prevented. Alternatively, if the fastener is stuck or stripped in the hole, the counter rotation of the socket 110 will not partially extract the fastener. Thus, by wedging the hook 134 between the fastener head 21 and the tie 18, and also by pushing the fastener against one side of its mounting hole, the laterally directed biasing force F of the latch hook 134 assists the drive socket 110 in the extraction operation. Whether or not the fastener is stripped in its hole, it must be fully extracted from the hole. That is the primary goal of the latch hook 134.

Figure 2D:
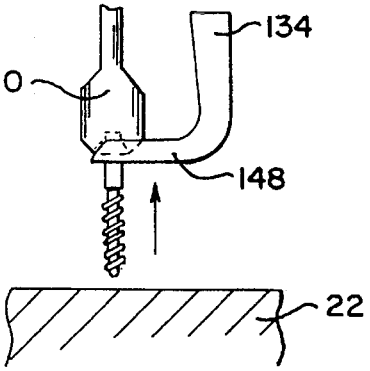
Figure 5:
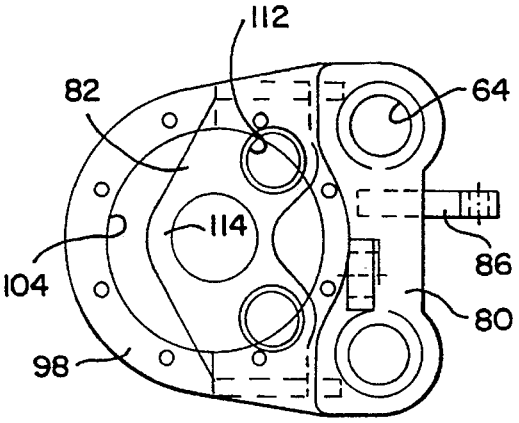
FIG. 5 is an overhead plan view taken along the line 5—5 of FIG. 2.

As the hook 134 engages the fastener, the beveled edge 152 facilitates the wedging of the hook under the head 21. Also, the curved recess 154 defines a support zone for the fastener on the hook. Full engagement and support of the fastener 20 by the hook 134 is shown in FIG. 2*d*. The biasing force exerted by the hook cylinder 162 also assists in removing fasteners retained in stripped holes, in that the threads of the laterally biased fastener may be caused to "bite" the existing threads of the hole. Stripped fasteners are also assisted out of the hole by the wedging action of the hook 134 under the fastener head 21.

Returning to FIG. 4, subsequent to the four functions described in relation to boxes 206–212, the drive cylinder 90 continues to lift the socket 110, the hook 134 and the retained fastener 20 until the UP position limit switch 176 is triggered, as seen in box 214. The UP position limit switch 176 is triggered when the switch senses the top 180 of the drive mount position bar 182. Upon the triggering of the switch 176, the drive cylinder 90 is turned off or de-energized to stop the upward travel of the drive mounting bracket 74, as seen in box 216. Simultaneously, the motor 100 is turned off to stop counter rotating the extension 108 and the drive socket 110, seen in box 218. Also at this time, the latch hook cylinder 162 is deenergized, as seen in box 220, and the return springs 172 retract the cylinder. The hook 134 thus pivots back to its original position away from the fastener 20 (best seen in FIG. 2), which allows the fastener to drop to the ground. The operator then causes the base unit 12 to move along the track 14 to engage the next fastener, and the above-described cycle is repeated.

It will be seen that the present automatic rail fastener remover permits threaded rail fasteners, whether they are lag screws or nuts, to be rapidly removed from ties, even when the fastener is stripped in its retaining hole. Also, the construction of the latch hook aids in the extraction and support of removed fasteners. Further, the coordinated sequentially timed operation of the removal tools, i.e. the latch hook and the extension through the drive cylinder, optimizes the inherent advantages of these tools in removing fasteners under a wide range of field situations.

While a particular embodiment of the automatic rail fastener remover of the invention has been shown and described, it will be appreciated by those skilled in the art that changes and modifications may be made thereto without departing from the invention in its broader aspects and as set forth in the following claims.

What is claimed is:

1. An automatic rail fastener remover for use on threaded fasteners used to secure rails to rail ties, said fastener remover constructed and arranged to be mounted on a railway maintenance vehicle having a frame, comprising:

a fastener removal tool configured to releasably engage one of the fasteners for removing the fastener from the tie;

a drive assembly connected to said tool for rotating said tool;

at least one holding means on said fastener remover for maintaining engagement of said tool with the fastener in the removal of the fastener from the tie, said holding means including a latch hook; and a hook guide assembly for manipulating said latch hook relative to at least one of the tie and a tie plate so that said latch hook engages at least one of the tie and the tie plate independently of the engagement of said fastener removal tool upon the fastener, said engagement of said latch hook with at least one of the tie and the tie plate generating a signal for energizing said drive assembly.

2. The fastener remover as defined in claim 1 wherein said holding means is also for facilitating the complete extraction of the fastener from the tie.

3. The fastener remover as defined in claim 1 further including a releasable biasing device for laterally biasing said holding means against the fastener.

4. The fastener remover as defined in claim 3 wherein said biasing device includes a fluid power cylinder for exerting a biasing force against said hook to cause said biasing action.

5. The fastener remover as defined in claim 4 further including a controller for controlling the rotation of said tool, and for controlling the release of the biasing action of said holding means.

6. The fastener remover as defined in claim 5 wherein said controller includes a delay function for delaying the exertion of the biasing force until the tool has engaged and partially removed the fastener.

7. The fastener remover as defined claim 6 wherein said controller is constructed and arranged to simultaneously counter-rotate the fastener, begin raising said rotating tool, and energize the biasing force of said latch hook against the fastener.

8. The fastener remover as defined in claim 5 wherein said controller includes a delay function for delaying exertion of the biasing force until the removal tool is allowed a predetermined amount of time to attempt extraction of the fastener from the tie when the fastener is stripped and is not partially extracted by the tool.

9. The fastener remover as defined in claim 3 wherein said holding means is connected to said hook guide assembly to exert a vertical force upon the tie upon the commencement of the removal of one of the fasteners.

10. The fastener remover as defined in claim 1 further including a carriage assembly connected to the frame for positioning the tool relative to the fastener.

11. The fastener remover as defined in claim 10 wherein said fastener remover and said carriage assembly are removable attached to the frame as a unit.

12. The fastener remover as defined in claim 1 further including a locating assembly connected to said tool and to the frame for reciprocating said tool relative to the fastener, and wherein said locating assembly includes a drive unit mounting which reciprocates relative to the frame, and said latch hook guide assembly is slidaby engaged in said locating assembly.

13. The fastener remover as defined in claim 12 wherein said drive unit mounting includes a lower bracket with at least one sleeve, and said latch hook guide assembly includes a mounting weldment with at least one vertically projecting rod which slidably engages a corresponding one of said sleeves.

14. A railway maintenance machine having an automatic rail fastener remover for use on threaded fasteners used for securing railroad rails to rail ties of a railroad track, said machine comprising:

a frame being movable along the track;

a fastener remover being mounted to said frame and including a fastener removal tool configured to releasably engage one of the fasteners for removal from the tie;

a drive assembly connected to said tool for rotating said tool;

a locating assembly connected to said tool and to said frame for reciprocating said tool relative to the fastener between a ready position and an engagement position; and at least one holding means mounted on said fastener remover for assisting said tool in the removal of the fastener from the tie;

a hook guide assembly connected to said at least one holding means for exerting a vertical force upon at least one of the tie and a tie plate independently of the engagement of said fastener removal tool upon the fastener upon the commencement of the removal of one of the fasteners.

15. The machine as defined in claim 14 further including said hook guide assembly being associated with said locating assembly for manipulating said holding means relative to at least one of the tie and the tie plate so that the holding means engages at least one of the tie and the tie plate independent of the engagement of said tool upon the fastener, said engagement of said holding means with at least one of the tie and the tie plate generating a signal energizing said drive assembly.

16. An automatic rail fastener remover for use on threaded fasteners used to secure rails to rail ties, said fastener remover constructed and arranged to be mounted on a railway maintenance vehicle having a frame, comprising:

a fastener removal tool configured to releasably engage one of the fasteners for removing the fastener from the tie;

a drive assembly connected to said tool for rotating said tool;

at least one holding means on said fastener remover for maintaining engagement of said tool with the fastener in the removal of the fastener from the tie;

a releasable biasing device for laterally biasing said holding means against the fastener; and a controller for controlling the rotation of said tool, and for controlling the release of the biasing action of said holding means, said controller including a delay function for delaying the exertion of the biasing force.

17. The fastener remover as defined in claim 16 wherein said delay function delays the exertion of the biasing force until the tool has engaged and partially removed the fastener.

18. The fastener remover as defined in claim 16 wherein said delay function delays exertion of the biasing force until the removal tool is allowed a predetermined amount of time to attempt extraction of the fastener from the tie when the fastener is stripped and is not partially extracted by the tool.

19. An automatic rail fastener remover for use on threaded fasteners used to secure rails to rail ties, said fastener remover constructed and arranged to be mounted on a railway maintenance vehicle having a frame, comprising:

a fastener removal tool configured to releasably engage one of the fasteners for removing the fastener from the tie;

a drive assembly connected to said tool for rotating said tool;

at least one holding means on said fastener remover for maintaining engagement of said tool with the fastener in the removal of the fastener from the tie; and a locating assembly connected to said tool and to the frame for reciprocating said tool relative to the fastener, and wherein said locating assembly includes a drive unit mounting which reciprocates relative to the frame, and a latch hook guide assembly which is slidably engaged in said locating assembly.

20. The fastener remover as defined in claim 19 wherein said drive unit mounting includes a lower bracket with at least one sleeve, and said latch hook guide assembly includes a mounting weldment with at least one vertically projecting rod which slidably engages a corresponding one of said sleeves.

* * * * *

UNITED STATES PATENT AND TRADEMARK OFFICE

CERTIFICATE OF CORRECTION

PATENT NO. : 5,577,447
DATED : November 26, 1996
INVENTOR(S) : Robert M. Weber
William D. Straub It is certified that error appears in the above-indentified patent and that said Letters Patent is hereby corrected as shown below:

On the Title Page:

Under "[54]", delete "AUTOMATIAC" and insert --AUTOMATIC--.

Under "[56] References Cited, U.S. Patent Documents" insert --4,928,600 5/1990 Urmson Jr. et al. 104/17.1--.

UNITED STATES PATENT AND TRADEMARK OFFICE

CERTIFICATE OF CORRECTION

PATENT NO. : 5,577,447
DATED : November 26, 1996
INVENTOR(S) : Robert M. Weber
William D. Straub It is certified that error appears in the above-indentified patent and that said Letters Patent is hereby corrected as shown below:

Column 1, line 1, delete "AUTOMATIAC" and insert --AUTOMATIC--.

Column 4, line 7, delete "2" and insert --22--.

Column 7, line 67, delete "designates "input" " and insert --designates input.--.

Signed and Sealed this
Twenty-third Day of December, 1997

Bruce Lehman

*Attest:*

BRUCE LEHMAN

*Attesting Officer*

*Commissioner of Patents and Trademarks*